US005671939A

United States Patent [19]

Pineau

[11] Patent Number: 5,671,939

[45] Date of Patent: Sep. 30, 1997

[54] BINDING MOUNT ASSEMBLY FOR AN ALPINE SKI

[76] Inventor: David G. Pineau, 22 Intervale Rd., Wellesley, Mass. 02181

[21] Appl. No.: 401,966

[22] Filed: Mar. 10, 1995

[51] Int. Cl.[6] ..... A63C 5/00

[52] U.S. Cl. ..... 280/602; 280/607; 280/618

[58] Field of Search ..... 280/607, 617, 280/618, 602, 633, 636

[56] References Cited

U.S. PATENT DOCUMENTS

| | | | |
|---|---|---|---|
| 4,139,214 | 2/1979 | Meyer | 280/607 |
| 4,896,895 | 1/1990 | Bettosini | 280/618 X |
| 5,046,751 | 9/1991 | Scherübl | 280/617 X |
| 5,129,668 | 7/1992 | Hecht | 280/607 |
| 5,326,126 | 7/1994 | Ruffinengo | 280/618 X |
| 5,437,468 | 8/1995 | Schenner | 280/607 X |

*Primary Examiner*—Brian L. Johnson
*Assistant Examiner*—Michael Mar
*Attorney, Agent, or Firm*—Wolf, Greenfield & Sacks, P.C.

[57] ABSTRACT

A binding mount assembly for an alpine ski includes a mounting system for removably receiving a ski binding carrier. The binding mount assembly is selectively altered by the skier between a fixed mode where the ski beneath the binding mount assembly is inhibited from flexing and a float mode where the same segment of the ski is allowed to assume its natural arc. Sliding and fixed junctions between the mounting system and the binding plate allow pivotal and/or axial movement between these components. Canting or ramping shims are provided and may be quickly and easily installed and removed by the user.

15 Claims, 11 Drawing Sheets

BINDING MOUNT ASSEMBLY FOR AN ALPINE SKI

FIELD OF THE INVENTION

The invention relates to a binding mount assembly for an alpine ski.

BACKGROUND OF THE INVENTION

An alpine ski typically has an arc or camber provided in its central portion. Bindings for receiving a skiers boots are attached to the central portion of the ski so that the skiers weight is applied to the ski's midsection. When performing a turn, the ski assumes a reversed catered configuration wherein the ski assumes a single continuous arc from its tip to its tail. Alpine skis have metal edges that extend along their length from tip to tail. To execute a turn, the ski is placed on edge and the skier shifts his weight to the turning ski. The skiers weight generates a force that places the ski in the reverse catered configuration wherein it forms an arc. The ski then travels through the arc, along its edge, thereby carving an arc through the snow to execute the turn. The arc of the ski during a turn defines the radius of the turn. Thus, changes in the geometry of the ski arc can impact the skiers ability to turn on the ski.

An alpine ski is typically provided with a binding for releasably receiving the skiers boot. The binding is rigidly attached to the ski at front and rear portions, with the boot being fixably secured therebetween. As a result, the central portion of the ski is stiffened, creating a "flat spot" under the skier's weight from the front portion of the binding to the rear portion.

The ski industry has attempted to address the issue of the flat spot. Recent efforts have been primarily concentrated in two categories; sliding binding components or under-binding devices. Although both have achieved some success, current implementations still have drawbacks.

Some ski bindings have heel pieces that slide rearward as the ski arcs. This effectively increases the distance (along the arc of the ski) between toe and heel pieces. Changes in relative toe and heel binding position can potentially affect binding safety, releasability and retention. Some bindings operate as a single unit, with toe and heel pieces linked. These deal with flex by allowing the unit to slide rearward on a track directly on the ski. Both of these methods operate by keeping the bindings affixed and parallel to the surface of the ski. This orientation does not completely resolve the flat spot issue because pressure is still applied across the entire length of the boot/binding region inhibiting the distal ends of this region from freely forming an arc.

Under-binding devices have also been developed to address this issue. Two primary types have been proposed: center mounted and end mounted. Center mounted devices are affixed at the center of the ski and allow the ends to slide over the ski. Like the sliding binding units, they are forced to slide along the surface of the ski and hence are not completely effective. End-mounted devices have been found to actually increase the flat spot region of a ski by effectively lengthening the binding region and applying pressure further out toward the ends of the ski.

Although these efforts have been taken to reduce the flat spot and allow a more continuous arc to the ski, there are situations where this flat spot is desirable. Products such as the end mounted under-binding devices have actually been shown to improve skiing under certain conditions by effectively enhancing this flat spot region.

A problem with all these methods is that they do not allow the skier to selectively alter the flex characteristics of a ski. Those that try to reduce the flat spot do not allow the skier the option to increase it and those that enhance the flat spot do not offer the ability to reduce it.

Canting is a process by which the skier's boots are disposed at an angle to the edges of the ski. Canting is conventionally accomplished by disposing a plastic wedge or shim between the binding and the ski. The shims can be selected and sized to angle the bindings and, consequently, the skier's boots will be secured thereto at an angle toward the inner edges of the skis, or toward the outer edges.

Although the above-described conventional manner of canting accomplishes its purpose of correcting a skier's body alignment, it suffers from disadvantages. First, once the canting shims are applied, each of the skis becomes dedicated to being either a right or left ski. This can reduce the life of the ski, by wearing the edges unevenly. Second, the process is fairly expensive and complicated because it involves the installation of the shims between the binding and the ski. This is a time consuming process that should be handled by professional binding installers. Additionally, this procedure must be performed for every pair of skis a skier may own.

Ski performance can also be affected by the positioning of bindings relative to the ski's midpoint. For example, mounting bindings forward of center usually causes a ski to initiate turns more quickly. Fore/aft repositioning of bindings has been possible for years. However, it has always required the use of special bindings, such as rental bindings or those specifically manufactured for this capability.

As set forth above, it is desirable to allow a skier to adjust various characteristics of his skis and/or bindings. Although various prior art devices have been developed to allow for the adjustability of particular features, they each suffer from several disadvantages. First, the prior art devices are typically not readily readjustable by the skier. Because they are semi-permanently attached to the skis, the prior art devices also suffer a disadvantage in that they cannot be used with another ski.

Serious skiers often alternate between two or more pairs of skis during the course of a ski season. For example, skiers may have one or more pairs of slalom and giant slalom skis. If each pair of skis is to be adjusted using an end-mounted binding or canting shim, the skier must provide an adjustment device for each pair of skis.

SUMMARY OF THE INVENTION

The present invention is a binding mount assembly for mounting ski bindings onto an alpine ski. The assembly includes a mounting system that is fixed to the ski and a binding carrier that securely carries the ski bindings. Preferably, the binding carrier includes a plate that is detachable so that the associated bindings may be remounted onto one or more other skis provided with a compatible mounting system. Consequently, the serious skier who owns several different pairs of skis need purchase only one set of bindings that can be moved from ski to ski, providing a dramatic cost savings over conventional practice where separate bindings must be permanently dedicated to each ski.

Additionally, or in the alternative, the binding mount assembly permits the skier to selectively vary the turning performance of the ski. The binding mount assembly may be used in either a "float mode" where the region of the ski beneath the bindings is allowed to naturally flex or a "fixed mode" where this same region is inhibited from flexing. The turning characteristics of a ski differ significantly between float and fixed modes. The flex profile of a pressured ski is illustrated in FIG. 1*c* (fixed mode) and FIG. 1*d* (float mode). Relative pivotal and axial movement between the binding plate and the mounting system is provided during float mode but is prevented, or at least minimized, during fixed mode to prevent flex of the ski through its midsection. Selective manipulation of a flex inhibitor allows the user to switch between modes, altering the curve profile of the ski edge to correspond to the style of skiing desired.

Advantageously, the skier may selectively switch between ski profile modes even while on the slopes, allowing the skier to vary the performance of the skis to match the conditions of the snow and terrain or type of skiing. The versatility of the binding mount assembly is particularly attractive given that conventional bindings typically are dedicated to a specific ski, do not provide a float capability and, even where float is permitted, do not allow the skier to selectively adjust between fixed and float modes.

Bindings and boots create a "flat spot" in the arc of the ski below the bindings, (see FIGS. 1*a* (unpressured) and 1*b* (pressured)), which affects the performance of the ski. It has been proposed recently to provide slidable bindings. However, these devices still track directly on the ski and, consequently, still deaden the arc of the ski beneath the bindings. The present invention, conversely, joins the ski at opposed end points allowing the ski to flex through its intermediate portion. Further, the present invention is not limited to specially configured slidable bindings but will permit variation of a ski profile regardless of the type of bindings employed.

The binding mount assembly, with fixed and float capability, may be permanently attached to a ski. However, it is seen to be particularly beneficial to provide the variable flex arrangement in a removable binding mount assembly so that the same binding carrier may be used on any alpine ski with the skier easily, and quickly, removing the binding carrier from (for example) a giant slalom ski and remounting that binding carrier onto a slalom ski, each of which is provided with a compatible mounting system.

The binding carrier itself may be canted. Mounting a canting shim to each binding carrier allows the canting orientation of each ski to be changed merely by switching the binding carrier between the skis so that the ski that previously served as the right ski may be used as the left ski and vice versa. This arrangement allows the skier to take advantage of both edges of the ski, as compared with conventionally canted skis which are permanently dedicated as a "right-canted" ski or a "left-canted" ski. This arrangement increases the longevity of the ski, allowing the skier to preserve the sharpness of the inside edge as distinguished from conventionally canted skis where the inside edge always remains the inside edge. Also, a ski may be returned to an uncanted state simply by removing the canting shim from the binding mount assembly and remounting the binding carrier directly to the mounting system. Where the binding carrier is removable, only one pair of bindings have to be canted for a skier's entire collection of skis to be canted. Remounting the binding carrier onto another ski automatically cants the new ski in the desired orientation. The cost and complications of having a ski canted by an experienced binding installer therefore is avoided with the present invention. The arrangement of the canting structure in the present invention also lends itself to experimenting with different canting angles without necessitating complex and timeconsuming dismounting and remounting of the binding to the ski as is currently required.

Fore/aft positioning of the bindings is facilitated by the present invention where the binding plate is moveable in centimeter or other predetermined increments relative to the mounting system. Varying the position of the bindings relative to the centerline of the ski may alter the performance of the ski, which may be desirable depending upon snow conditions or skiing style. The bindings do not have to be configured for fore/aft positioning, rather, the binding mount assembly allows for repositioning.

It is an object of the present invention to provide a binding mount assembly for an alpine ski.

Other objects and features of the present invention will become apparent from the following detailed description when taken in connection with the accompanying drawings which disclose multiple embodiments of the invention. It is to be understood that the drawings are designed for the purpose of illustration only and are not intended as a definition of the limits of the invention.

DESCRIPTION OF THE DRAWINGS

The foregoing and other objects and advantages of the invention will be appreciated more fully from the following drawings in which.

DESCRIPTION OF PREFERRED EMBODIMENTS

Figure 1A:
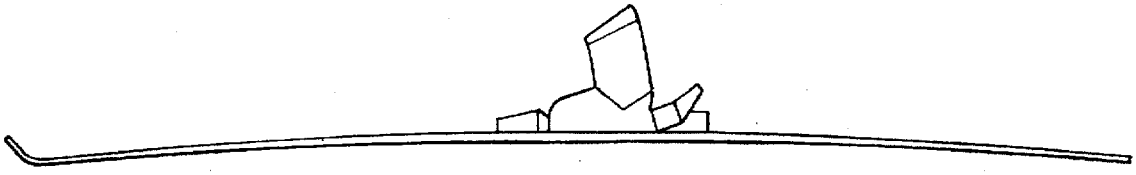
Fig. 1a PRIOR ART
FIGS. 1*a–d* are illustrations of a ski with prior art bindings (a–b) and with a binding mount assembly in accordance with the present invention (c–d)
Figure 1B:
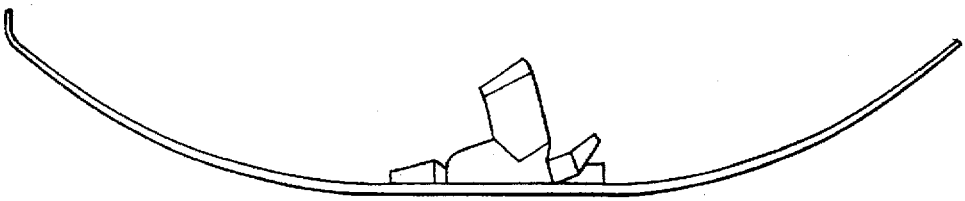
Fig. 1b PRIOR ART
Figure 1C:
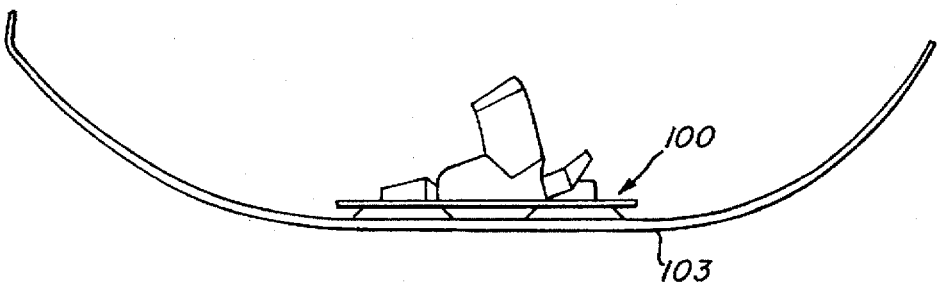
Figure 1D:
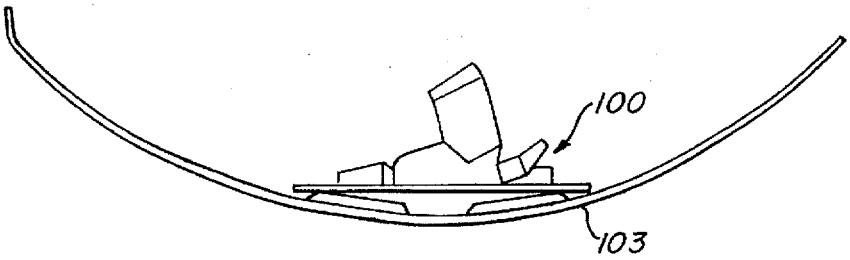
Figure 2A:
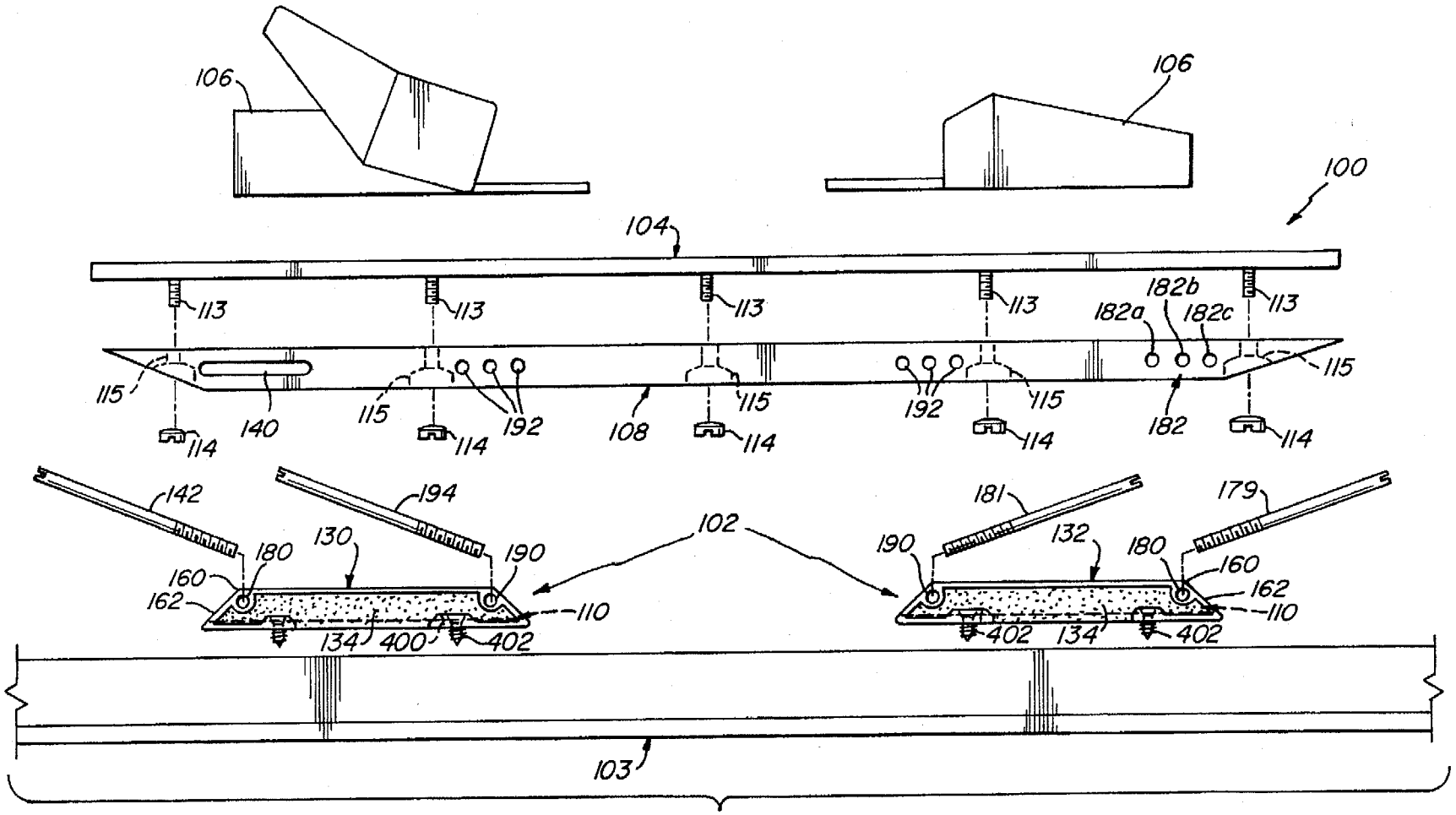
FIG. 2*a* is an exploded illustration of a binding mount assembly.
Figure 2B:
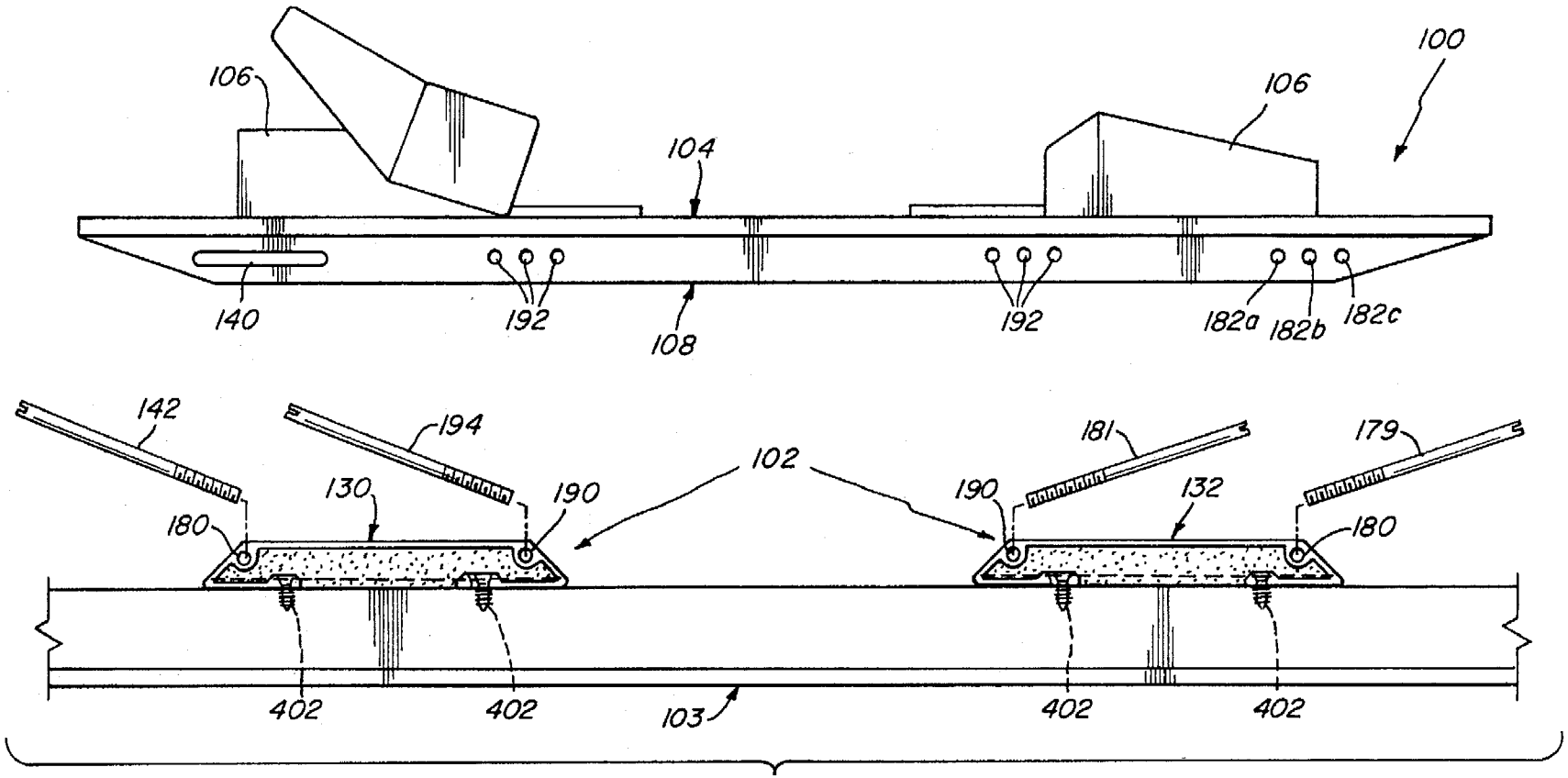
FIG. 2*b* is an illustration of an assembled binding plate and mounting system.
Figure 2C:
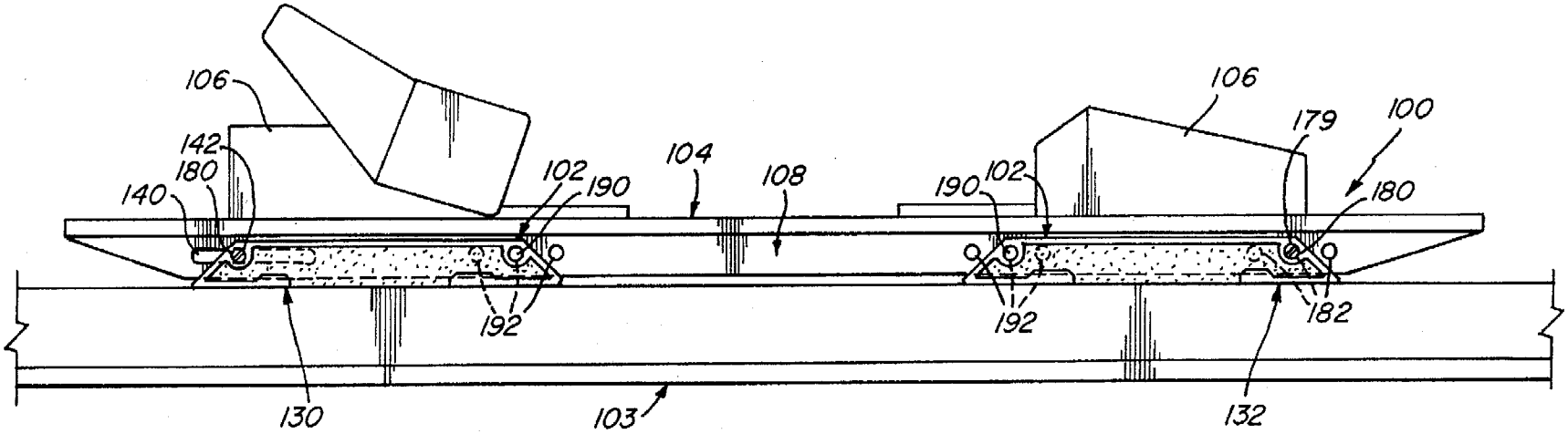
FIG. 2*c* is an illustration of the binding plate mounted to the mounting system.

The binding mount assembly 100 illustrated in FIGS. 2*a–c* includes a mounting system 102 and a binding carrier such as a binding plate 104. The binding plate 104 may be a thin, rigid member preferably having a width similar to the center portion of the ski 103 over which it is to be mounted. The plate may be formed of a strong, lightweight and durable material such as aluminum, titanium, alloys of aluminum and/or titanium, plastic, reinforced and/or composite fibers and combinations of the foregoing. The binding plate could also incorporate a layer of vibration absorbing material, such as in a "sandwich" type construction, to facilitate vibration dampening. While a rectangular shape is illustrated, other configurations are encompassed by the present invention, including an hour-glass configuration with a slender waist at the intermediate portion of the plate. A pair of bindings are securely engaged to the binding plate 104, for example, by threaded screws which terminate flush or proximate of the bottom surface of the binding plate.

Figure 3:
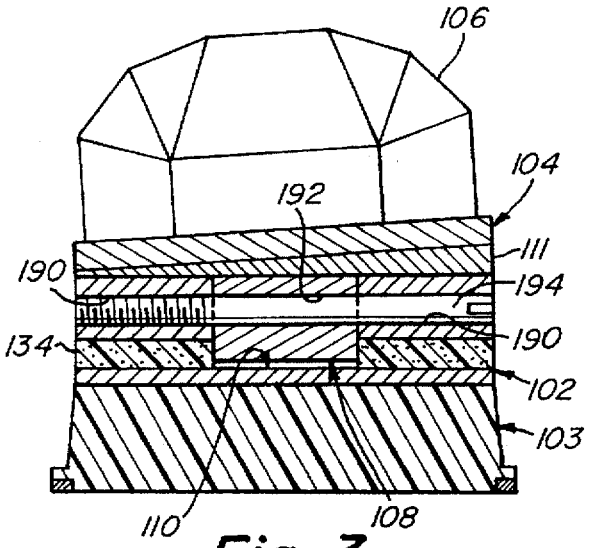
FIG. 3 is a sectional illustration of a canted binding mount assembly.
Figure 4:
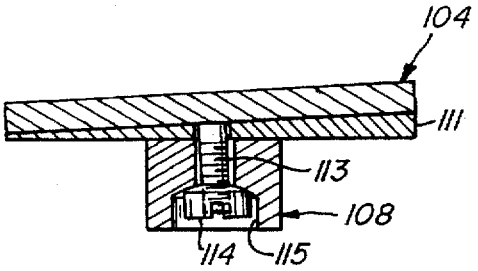
FIG. 4 is an illustration of a hemispherical nut and bore employed to retain a canted shim and binding carrier.
Figure 5A:
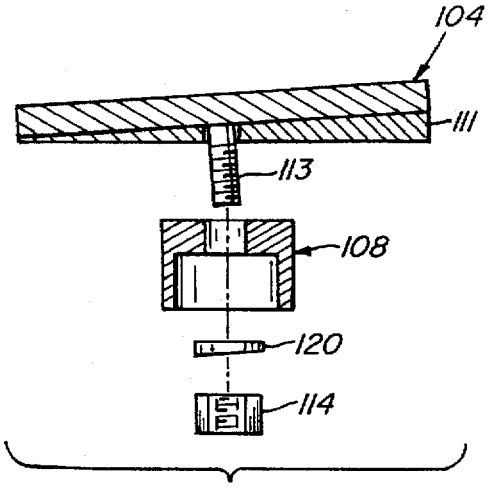
FIGS. 5*a–b* are sectional illustrations of a canted washer for retaining a canted shim and binding plate to the beam.
Figure 5B:
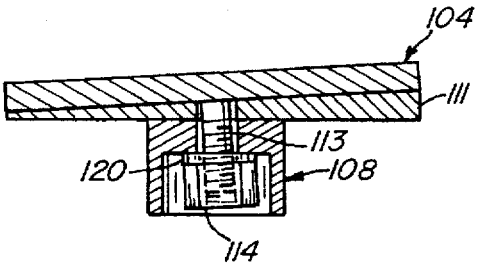

A beam 108 depends from the base of the binding plate 104 and is slidably and pivotally engaged with the mounting system 102, permitting the ski to flex during float mode as explained below. In a preferred embodiment, the beam 108 fits into a complementary slot 110 in the mounting system. The beam 108 imparts structural integrity to the binding plate. Lateral deflection of the binding plate 104 is prevented by the cooperation of the beam 108 and mounting system 102. Drafted portions reduce the weight of the beam. The binding plate and beam may be integrally formed or, preferably, are separate components which are secured together. The separable arrangement of the beam and binding plate allows a canting shim 111 to be positioned between the two components as illustrated in FIG. 3. Locking screws 113 and nuts 114 secure the binding plate and beam. The through holes 115 in the beam and the locking nuts 114 are hemispherically shaped or otherwise configured to accept the locking screw at an angle when a shim is employed, as shown in FIG. 4. Other arrangements for securing the angled screws also are contemplated. For example, appropriately angled washers 120 or nuts could be employed as illustrated in FIGS. 5*a–b*.

Figure 6:
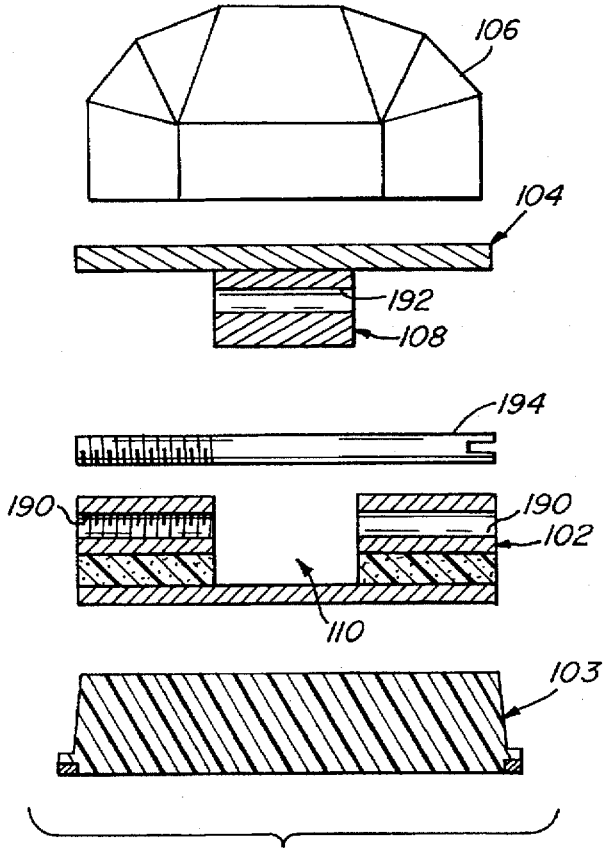
FIG. 6 is an exploded, sectional illustration of an arrangement for locking the beam and binding plate together.
Figure 14A:
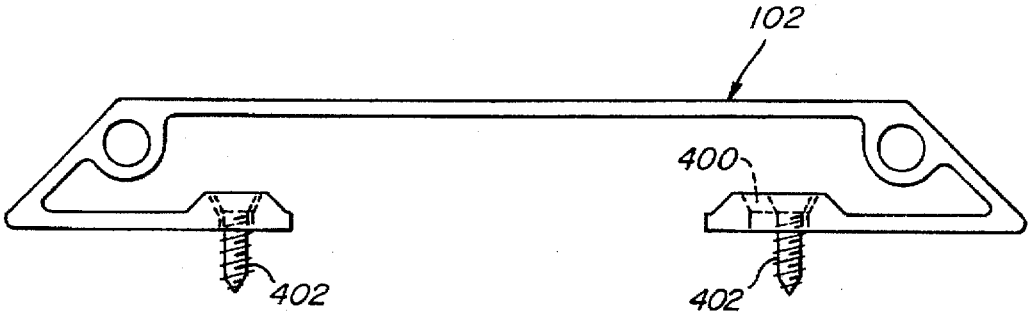
FIGS. 14*a–c* are illustrations of a leaf spring mounting plate.
Figure 14B:
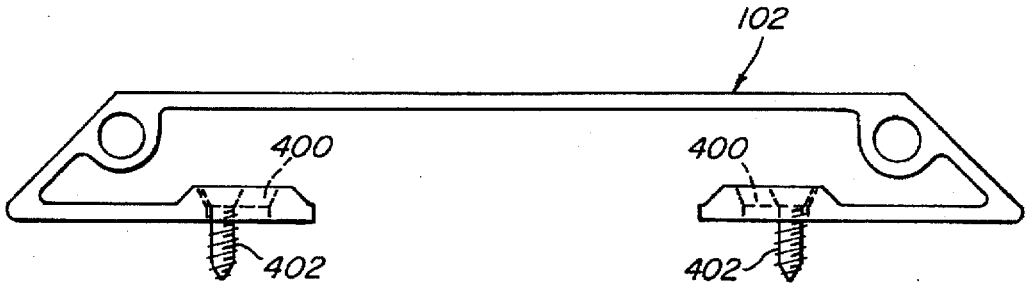
Figure 14C:
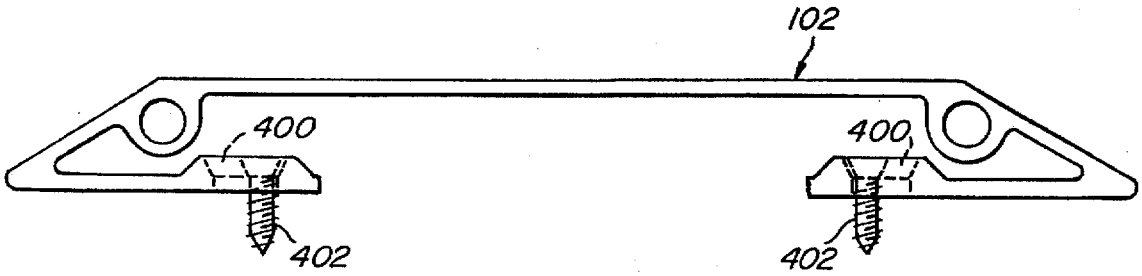

Turning back to FIGS. 2*a–c*, the mounting system preferably includes front 132 and rear 130 mounting plates which are spaced from each other on the ski. Alternatively, the mounting system may consist of a single plate that is constructed and arranged to allow movement between front and rear portions thereof as the ski flexes or may be integrated into the construction of the ski 103. The front and rear mounting plates are fastened to the ski by screws 402. Adhesive or other known methods of joining such materials also may be employed. The mounting plates preferably are constructed of aluminum, although other materials such as those referred to above in connection with the binding plate may also be employed. The mounting system may include a shock absorbing material 134, such as a polyurethane, to help reduce or eliminate chatter and shock, particularly when the ski is on edge. To enhance the shock absorbing capability of the mounting system, the plates may be configured with a leaf spring body such as the trapezoidal arrangement illustrated in FIGS. 2*a–c* and, specifically, in FIGS. 14*a–c*. The enlarged bores 400 permit the mounting plate to flex relative to the retaining screws 402. Other absorbing designs and arrangements also would be suitable as would be apparent to one of skill in the art. An axially extending channel 110 (see FIG. 6) is provided in the mounting plates to accept the complementary binding plate beam 108. The ends of the mounting plates may be sized to compensate for the non-uniform thickness of the ski, providing a level surface on which to mount the bindings.

A sliding junction allows relative pivoting between the binding plate and rear mounting plate and further allows the rear mounting plate to move axially so that the central portion of the ski below the bindings can flex during float mode. Because only a rearward portion of the beam cooperates in the sliding junction, the entire length of the beam need not be configured for slidable receipt in the mounting plate channel. To enhance the structural integrity of the beam, the non-slidably engaged portion may be more solidly configured.

Preferably, the sliding junction includes a longitudinal slot 140 in the beam which accepts a pin 142 that spans from one side of the mounting plate to the other. The ends of the pin may be threaded to provide a secure engagement with threaded openings in the mounting plate. Other arrangements for fastening the pin are contemplated as would be apparent to one of skill in the art. The binding plate retains its orientation while the ski beneath it flexes. The sliding junction is preferably located at an apex 160 of a reduced dimensioned or truncated portion 162 of the mounting plate, ensuring that there is sufficient clearance for the ski to flex. A mirror image reduced dimensioned portion is provided in the front mounting plate as well. In the illustrated embodiment, the reduced dimensioned portion 162 has a downwardly sloping triangular shape. Other shapes which would permit the mounting plate to pivot relative to the binding plate also are contemplated as would be apparent to one of skill in the art.

Figure 7B:
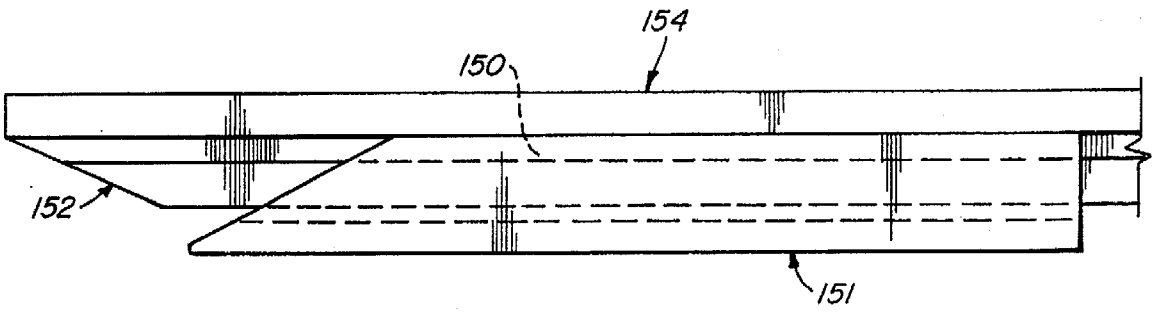
FIGS. 7*a–b* are illustrations of an alternative sliding junction between the binding plate and the mounting system.
Figure 7A:
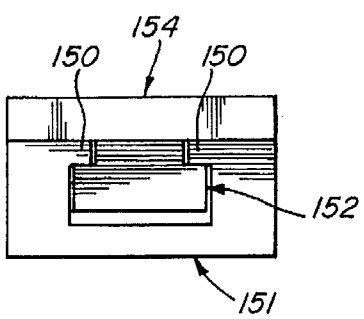

In an alternative embodiment illustrated in FIGS. 7*a–b*, the sliding junction includes a pair of inwardly projecting tabs 150. The tabs define a narrow neck within the mounting plate 151 which prevents the beam from deflecting upwardly, while still allowing for relative axial and pivotal movement between the mounting plate 151 and the binding plate 154. The tabs ride along the radially extending ends of a T-shaped beam 152 when the ski is flexed, yet resist the upward pull of the beam which could cause the binding plate 154 to separate from the ski.

Figure 8:
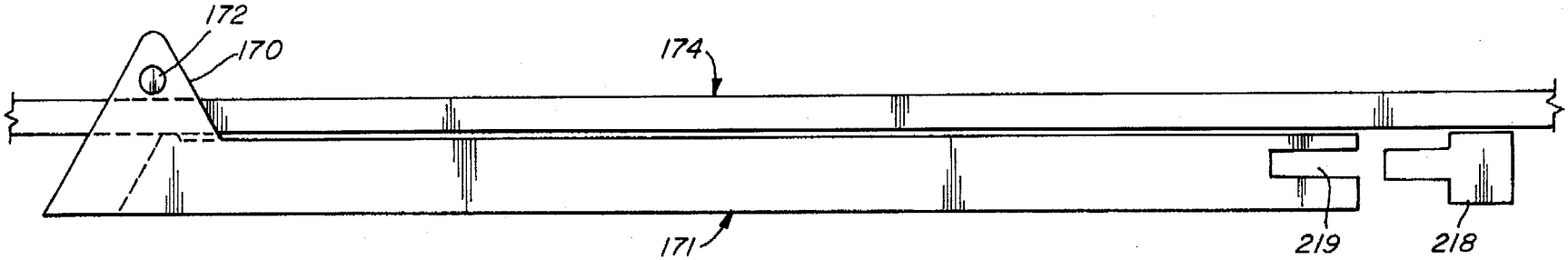
FIG. 8 is an illustration of an alternative binding mount assembly.

Although the preferred sliding junction includes a pin and slot arrangement, other structural configurations also are contemplated which will permit the rear mounting plate to slide and pivot relative to the binding plate as the ski beneath the bindings is flexed. An alternative sliding junction is illustrated in FIG. 8 and includes a frame 170 component of the mounting plate 171 for supporting a rotatable pin 172. The upper surface of the binding plate is flush with the rotatable pin which prevents separative forces from pulling the binding plate off of the ski. Rotation of the pin permits the rear mounting plate to slide, forwardly or rearwardly and for relative pivotal movement between the binding plate and the rear mounting plate. Other sliding junction arrangements are contemplated as would be apparent to one of skill in the art.

A fixed junction is provided between the front mounting plate 132 and the binding plate 104 that allows pivotal movements of these components but prevents axial movement therebetween. A preferred fixed junction includes a locking member 179 that spans across the mounting plate and a through channel 182 in the binding plate beam. The through holes 180 in the mounting plate and the member may be threaded to provide a secure connection. Other arrangements for securing the locking pin 179 to the mounting plate are contemplated as would be apparent to one of skill in the art. The beam preferably include a series of spaced channels 182*a, b* and *c* to allow selective positioning of the binding plate on the ski. Relocation of the bindings, forward or rearward, of the mid-line of the skis will alter the turning characteristics of the ski. It is contemplated to provide 1 cm spacing between adjacent pairs of positioning holes. Of course, other increments can be employed as would be apparent to those of skill in the art.

Figure 9A:
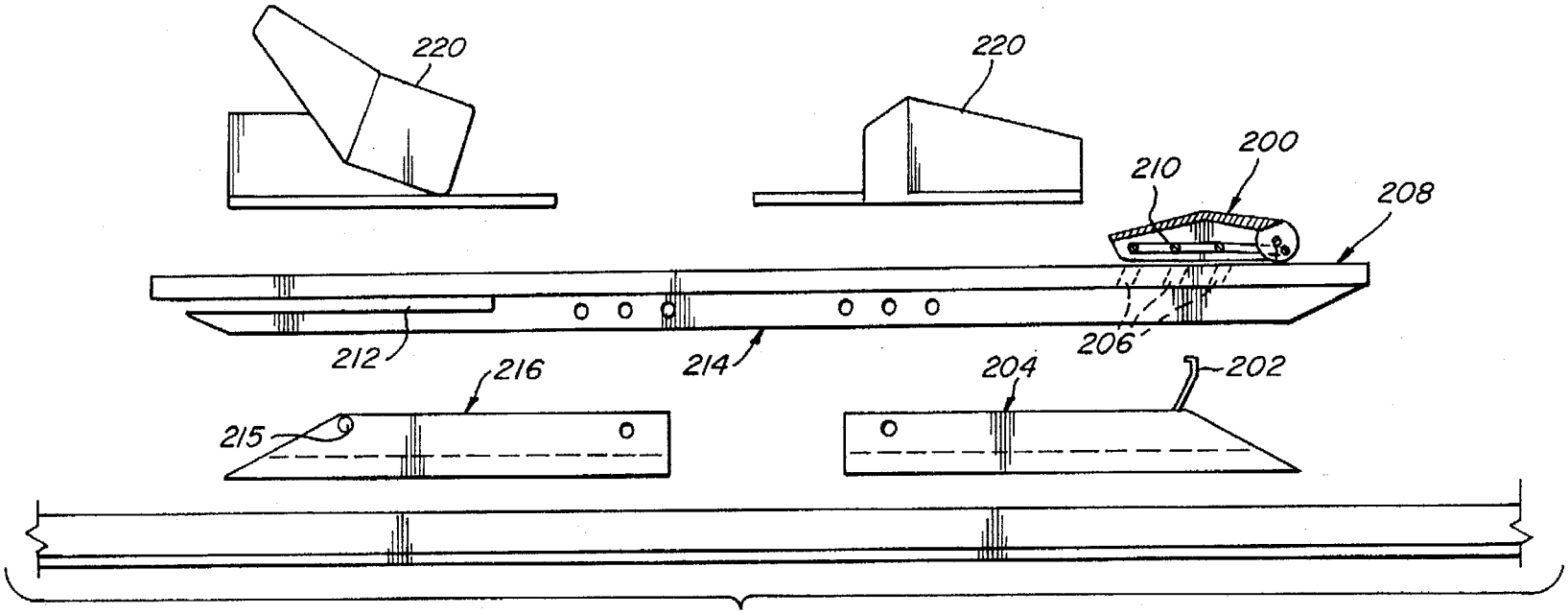
FIGS. 9*a–b* are illustrations of a buckle-type fixed junction binding mount assembly.
Figure 9B:
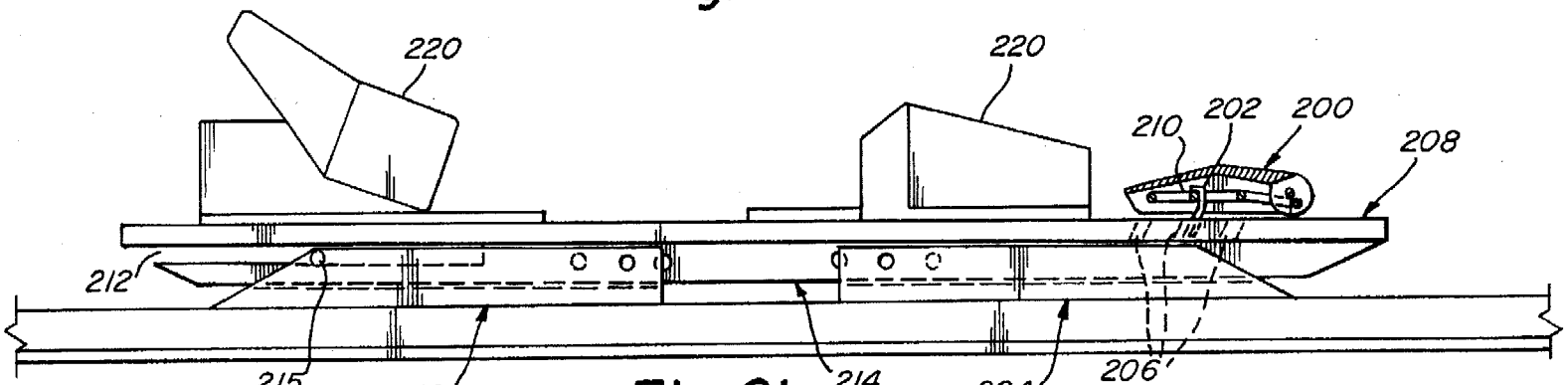

In an alternative embodiment shown in FIGS. 9*a–b*, the fixed junction includes a buckle mechanism 200 for securing a locking element, such as one or more tabs or hooks 202, that project upwardly from the front mounting plate 204 through corresponding holes 206 in the binding plate 208. The bail 210 of the buckle engages curved distal ends of the locking elements when the buckle is closed, securely fixing the binding plate to the front mounting plate. The binding plate openings 206 may be angled to tightly draw the binding plate against the mounting plate when the buckle is locked. The buckle lever preferably faces rearwardly, rather than forwardly, to reduce the likelihood of the buckle inadvertently opening due to contact with a ski pole or other object. Also, frontside pivoting of the lever increases the surface of the binding plate available for mounting the bindings 220. Alternatively, the buckling mechanism could be incorporated into the distal section of the mounting plate to engage complementary hooks on the binding plate or beam.

In the FIGS. 9*a–b* embodiment, the sliding junction at the rear of the binding mount assembly is formed by a slot 212 in a beam 214 which cooperates with a transverse pin 215 that extends across the rear mounting plate 216. The slot 212 is open-ended, allowing the binding plate to be slidably inserted into the mounting system. When the ski is flexed during the "float" mode, the front and rear mounting plates 204, 216 pivot downwardly with the rear mounting plate 216 moving axially closer to the front mounting plate 204 along the sliding junction. When the ski relaxes, the mounting plates reciprocally pivot back towards the binding plate and the rear mounting plate traverses along the beam towards its original position.

Figure 10A:
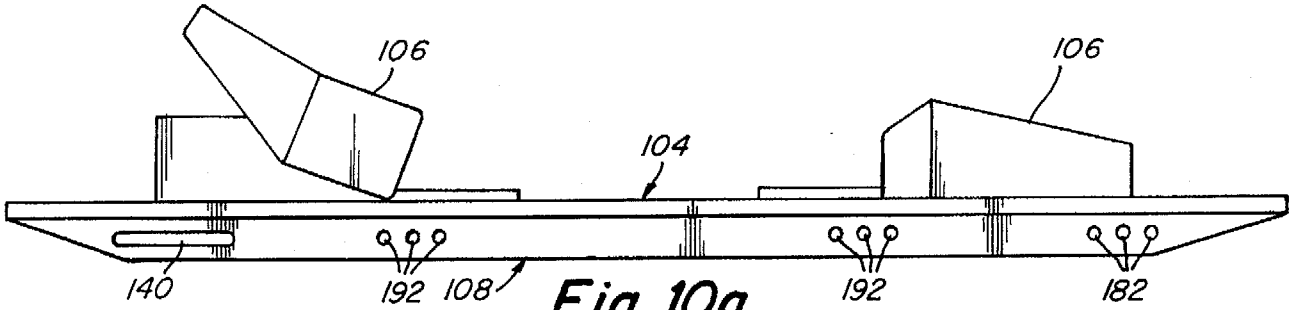
FIGS. 10*a–c* illustrate the reversability of the sliding and fixed junctions.
Figure 10B:
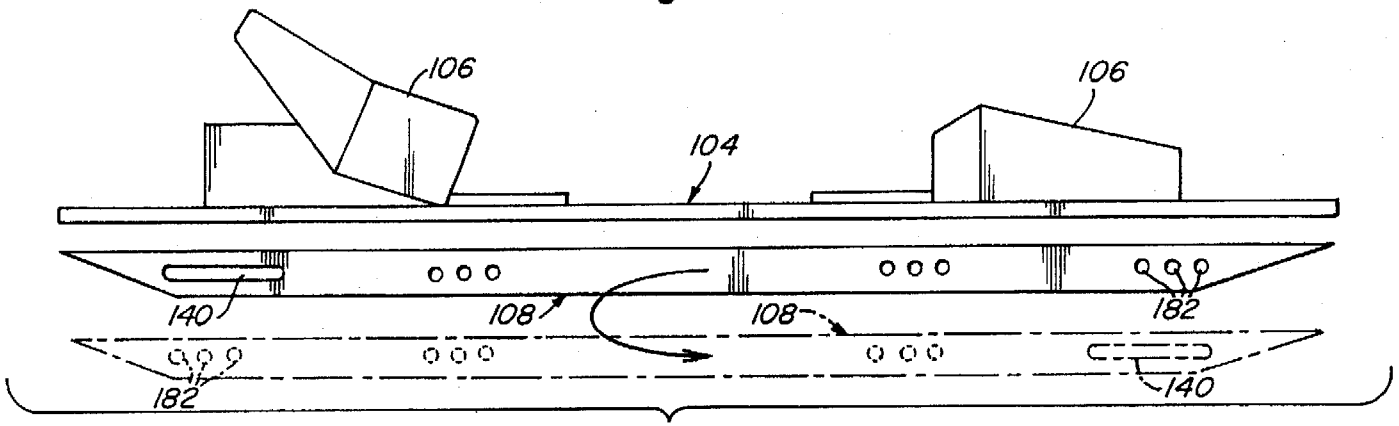
Figure 10C:
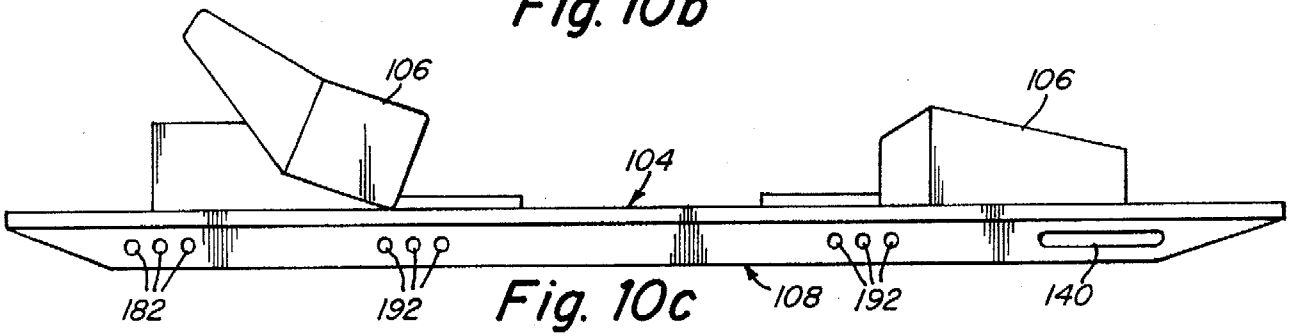

Other arrangements for fixedly, but pivotally, connecting the front mounting plate and the binding plate also would be suitable as would be apparent to one of skill in the art. In the illustrated embodiments, the sliding junction is provided relative to the rear binding. The sliding junction may be transferred to the front binding simply by reversing the orientation of the beam so that the sliding slot is provided at the front mounting plate, as is shown in FIGS. 10*a–b*.

Figure 2D:
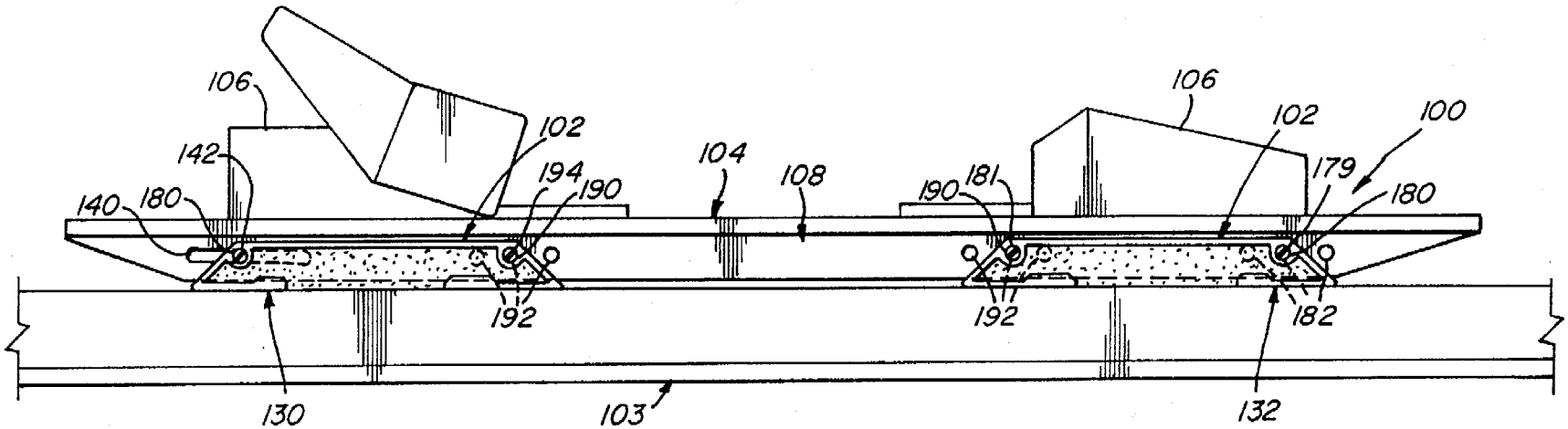
FIG. 2*d* is an illustration of the binding plate mounted to the mounting system with an activated flex inhibitor.

In the fixed mode, the region of the ski under the binding is stiffened, sharply reducing the flex at the central region of the ski while accentuating the flex of the tail region of the ski. The consequence is a dramatic arc in the tail. To maintain the ski in a fixed mode, the rear mounting plate is prevented from axially traversing the binding plate beam. A flex inhibitor is provided in the binding mount assembly to disable the sliding junction. In one arrangement, the flex inhibitor includes complementary throughholes 190, 192 in the sidewalls of the mounting plates and in the binding plate beam which are dimensioned to receive locking pins 194, 181 (see FIGS. 2*d* and 6). Markings may be provided on the edge or upper surface of the binding plate to facilitate registering the bindings and mounting plates. The pin may be friction fit through the beam and mounting plate, or threadably engaged to the openings in the mounting plate or to a fastener applied against the sidewall of the mounting plate.

Another embodiment of the flex inhibitor is illustrated in FIG. 8 where the binding plate beam 171 slidably mounts a pair of locking tabs 210. Complementary slots are provided in the front and rear mounting plates for securely accepting the tabs. The mounting plate slots and the locking tabs may be dimensioned for frictional engagement or additional locking structure may be provided for securing the tabs in position within the mounting plate slots, such as a slidable locking tongue carried by the mounting plate which is moveable into a compatible groove in the tab. Rubber or other suitable material may be provided on the surface of the slot and, or alternatively, on the mating surface of the tab to enhance the force fit. It also is contemplated that the frictional engaging surface may be texturized to promote the engagement between the tab and the mounting plate. Alternatively, a pin and enlarged slot arrangement may be employed, allowing limited axial motion. Additionally a compressible pin may be used to allow limited axial motion and to achieve an intermediate mode between fixed and float.

Figure 11A:
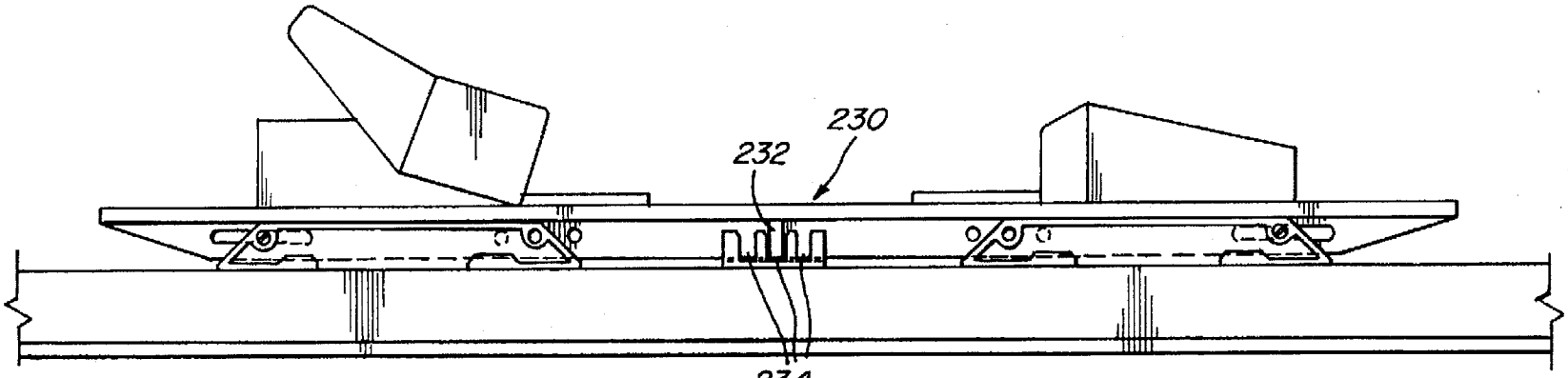
FIGS. 11*a–b* are illustrations of a binding mount assembly with front and rear sliding junctions.
Figure 11B:
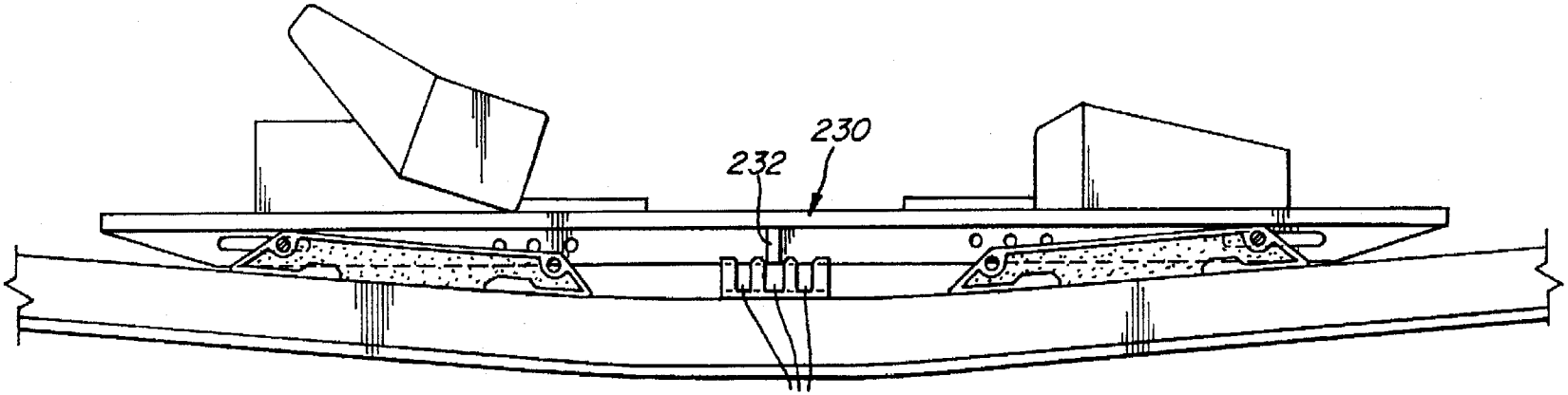

Preferably, the binding plate is removable from the mounting plate so that a single expensive pair of bindings, may be used with more than one ski rather than requiring the user to purchase a dedicated pair of bindings for each ski. As noted above, the cost savings engendered by the present invention should be especially attractive to the serious skier who is likely to have several pairs of skis, with each ski including an expensive ski binding. Notwithstanding, it also is contemplated that the binding mount assembly may be permanently joined to a ski solely to take advantage of the performance enhancing capabilities of the device. Here, the binding plate may be joined to the front mounting plate with conventional permanent structural arrangements such as screws, bolts, and other known fasteners. Further, while the binding mount assembly has been described with a sliding junction at the rear and a fixed junction at the front, it is contemplated that the junctions could be reversed and, alternatively, that both junctions could be fixed or both could be sliding in order to achieve the purposes of the invention. In a dual sliding junction assembly, illustrated in FIGS. 11*a–b*, a pin 202 and slot 204 allow flex of the ski but prevent excessive sliding. Here, the pin will ride up and down the slot as the ski assumes an arc.

The binding mount assembly lends itself to a simplified system for canting (illustrated in FIGS. 3–5), or ramping, alpine bindings. A shim preferably having the same length and width as the binding plate, is positioned underneath the binding plate prior to engagement with the beam. The shim imparts a cant angle (or ramp angle) to the binding plate, and therefore the bindings. The binding mount assembly may be quickly returned to an uncanted state by removing the shim. A spacer may be employed in uncanted systems to compensate for the longer retaining screws required when the binding mount assembly is canted. The spacer may be formed of vibrational dampening material and, or alternatively, of a friction reducing material. While a separable shim is preferred, it also is contemplated that the beam, binding plate lower surface and/or the mounting plate may be provided with an integral shim.

Figure 12:
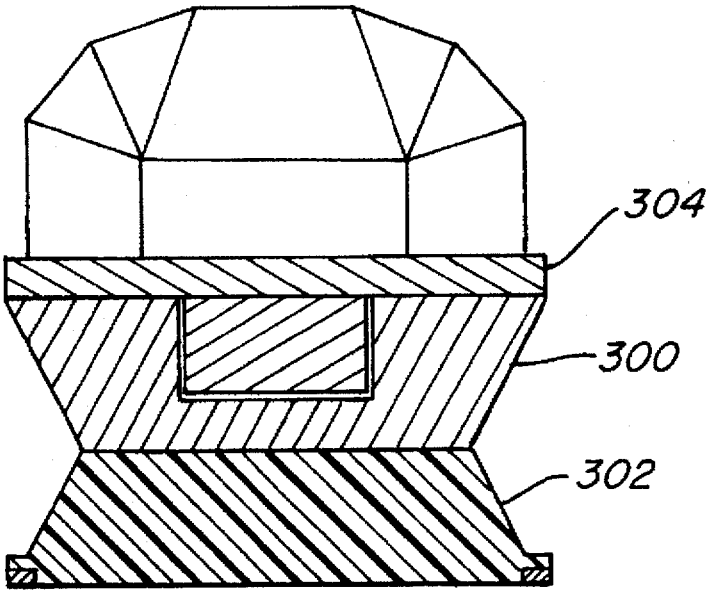
FIG. 12 is a sectional illustration of a downwardly and inwardly tapered mounting system.

In an alternative embodiment illustrated in FIG. 12, the mounting plate 300 may be inwardly tapered from top to bottom. This creates a narrower base of the mounting plate that would complement a ski 302 with a narrow sidecut and trapezoidal ("cap") construction. Consequently, skis could be designed with narrow waists and not be encumbered by the traditional width limitations dictated by the need to mount bindings directly to them.

Figure 13:
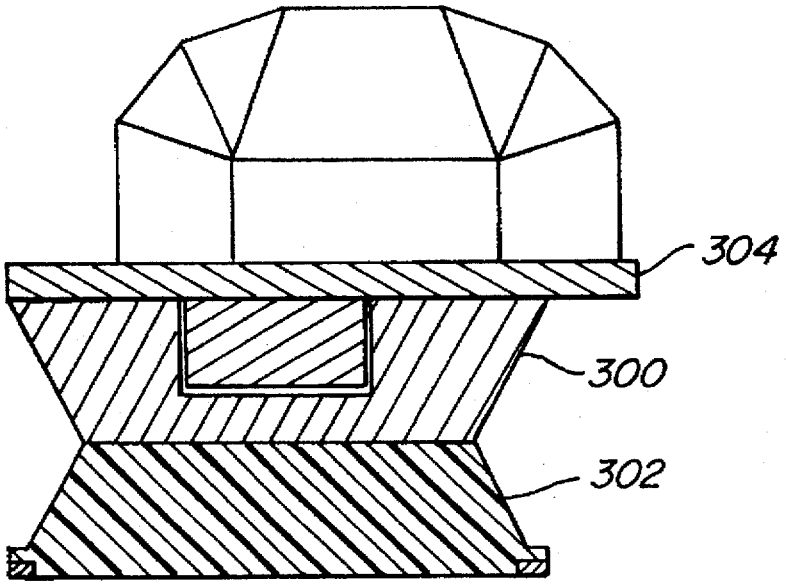
FIG. 13 is a sectional illustration of an eccentrically mounted binding carrier.

It also is contemplated that the binding plate 304 could be positioned offset of the mounting plate 300, as is shown in FIG. 13. Such arrangement would vary the skier's boot position relative to the ski edge.

Another embodiment of the binding plate includes a multiple piece construction with a front and rear piece slidably attached to the beam. Such construction would allow relative longitudinal adjustment of binding toe and heel units. This would allow the use of boots with different sole lengths to be used with the same binding plate unit.

While an essentially rectangular cross-sectional shaped beam has been illustrated, many other configurations are employable in the binding mount assembly, including U-shaped, inverted U-shaped, laminated and multiple beam. Further, the beam could be constructed with a slight convexity to its upper surface. It is contemplated that such a construction would serve to further stiffen the binding plate.

It should be understood that the foregoing description of the invention is intended merely to be illustrative thereof and that other equivalents, embodiments and modification of the invention should be apparent to those of skill in the art.

What is claimed is:

1. A binding mount assembly for mounting a binding over a portion of an alpine ski, said assembly comprising:

a mounting system which is fixable to the alpine ski; and a binding carrier that is mountable to said mounting system so that the binding spans the portion of the ski;

wherein said mounting system and said binding carrier cooperate when joined together to form a binding mount assembly having a first junction at a first end portion and a second junction at a second end portion that is longitudinally spaced from said first junction, at least one of said first and second junctions being selectively adjustable between a sliding arrangement that permits longitudinal and pivotal movement between said mounting system and said binding carrier and a fixed arrangement which prevents longitudinal movement and only permits pivotal movement therebetween, and wherein the other of said first and second junction is arranged to permit at least pivotal movement between said mounting system and said binding carrier, whereby the alpine ski may be in either a float mode where the portion of the ski beneath the binding is allowed to naturally flex and in a fixed mode where the flexing of the portion of the ski beneath the binding is inhibited.

2. The binding mount assembly recited in claim 1 wherein both of said first and said second junctions are selectively adjustable between a sliding arrangement that permits axial and pivotal movement therebetween and a fixed arrangement which only permits pivotal movement therebetween.

3. The binding mount assembly recited in claim 1 further including means for removably mounting said binding carrier to said mounting system.

4. The binding mount assembly recited in claim 1 wherein said mounting system is constructed and arranged to absorb vibrations of the ski.

5. The binding mount assembly recited in claim 1 wherein said mounting system includes vibration absorbing material.

6. The binding mount assembly recited in claim 1 further including means for selectively adjusting fore and aft positioning of said binding carrier.

7. The binding mount assembly recited in claim 1 wherein said mounting system is formed integral with the ski.

8. The binding mount assembly recited in claim 1 wherein said first and second junctions have been selectively adjusted into said sliding arrangement.

9. The binding mount assembly recited in claim 1 wherein said first and second junctions have been selectively adjusted into said fixed arrangement.

10. The binding mount assembly recited in claim 1 wherein one of said first and second junctions has been selectively adjusted into said sliding arrangement and the other of said first and second junctions has been selectively adjusted into said fixed arrangement.

11. The binding mount assembly recited in claim 1 wherein said binding carrier includes a plate adapted to support the binding and a beam depending from said plate, and said mounting system includes a slot adapted to receive said beam.

12. The binding mount assembly recited in claim 11 wherein said beam is removable and reattachable to said plate.

13. The binding mount assembly recited in claim 12 wherein said removable and reattachable beam has a first orientation and a second orientation relative to said plate, wherein said beam may be removed from said plate in said first orientation and reattached to said plate in said second orientation.

14. The binding mount assembly recited in claim 1 further including a shim for canting or ramping said binding carrier relative to the ski.

15. The binding mount assembly recited in claim 14 wherein said binding carrier includes a plate adapted to support the binding and a removeable beam depending from said plate, and wherein said shim is positioned between said removable beam and said plate.

* * * * *